US008268097B2

(12) United States Patent
Takahashi et al.

(10) Patent No.: US 8,268,097 B2
(45) Date of Patent: Sep. 18, 2012

(54) GRAIN-ORIENTED ELECTRICAL STEEL SHEET AND PRODUCING METHOD THEREFOR

(75) Inventors: Fumiaki Takahashi, Tokyo (JP); Kazutoshi Takeda, Tokyo (JP); Hiroyasu Fujii, Tokyo (JP); Shuichi Yamazaki, Tokyo (JP); Yoshiaki Natori, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/736,257

(22) PCT Filed: Mar. 30, 2009

(86) PCT No.: PCT/JP2009/056573

§ 371 (c)(1),
(2), (4) Date: Sep. 24, 2010

(87) PCT Pub. No.: WO2009/123156

PCT Pub. Date: Oct. 8, 2009

(65) Prior Publication Data

US 2011/0039114 A1 Feb. 17, 2011

(30) Foreign Application Priority Data

Mar. 31, 2008 (JP) ..... 2008-091051

(51) Int. Cl.
*H01F 1/18* (2006.01)

(52) U.S. Cl. ..... 148/308; 148/113; 148/307

(58) Field of Classification Search ..... None
See application file for complete search history.

(56) References Cited

U.S. PATENT DOCUMENTS

| | | | |
|---|---|---|---|
| 3,856,568 | A | 12/1974 | Tanaka et al. |
| 2009/0233114 | A1 | 9/2009 | Takeda et al. |

FOREIGN PATENT DOCUMENTS

| | | | |
|---|---|---|---|
| EP | 2 182 091 | A1 * | 5/2010 |
| JP | 48-39338 | | 6/1973 |
| JP | 54-130615 | | 10/1979 |
| JP | 61-235514 | | 10/1986 |
| JP | 06-065754 | | 3/1994 |
| JP | 7-268641 | | 10/1995 |
| JP | 2000-54155 | | 2/2000 |
| JP | 2005-187924 | | 7/2005 |
| JP | 2005-240079 | | 9/2005 |
| JP | 2007-023329 | | 2/2007 |
| JP | 2009-52060 | | 3/2009 |
| RU | 2 109 845 | | 4/1998 |
| WO | WO 93/03198 | | 2/1993 |
| WO | WO 2007/136115 | | 11/2007 |

OTHER PUBLICATIONS

Russian Office Action dated Jun. 27, 2011 issued in corresponding RU Application No. RU 2010139642/02.

International Search Report dated May 12, 2009 issued in corresponding PCT Application No. PCT/JP2009/056573.

Chinese Office Action dated Oct. 26, 2011 issued in corresponding Chinese Application No. 200980111435.0 [with English Translation].

* cited by examiner

*Primary Examiner* — John Sheehan
(74) *Attorney, Agent, or Firm* — Kenyon & Kenyon LLP

(57) ABSTRACT

A grain-oriented electrical steel sheet has a tension film that does not include chromium. In the present invention, the tension film, including a phosphate and silica as constituents, includes a manganese compound and a potassium compound. The mole ratio K/Mn of potassium to manganese in the film is set to a certain range. The film can be produced by preparing a coating solution by adding a compound, which includes the phosphate and the silica and also includes the potassium and the manganese, and applying the coating solution on a grain-oriented electrical steel sheet after final annealing is completed, followed by drying and baking.

13 Claims, No Drawings

GRAIN-ORIENTED ELECTRICAL STEEL SHEET AND PRODUCING METHOD THEREFOR

BACKGROUND OF THE INVENTION

1. Field of the Invention

The present invention relates to a grain-oriented electrical steel sheet, which has a film with excellent annealing resistance and does not include chromium therein, and a producing method therefor.

This application is a national stage application of International Application No. PCT/JP2009/056573, filed Mar. 30, 2009, which claims priority to Japanese Patent Application No. 2008-91051, filed Mar. 31, 2008, the content of which is incorporated herein by reference.

2. Description of Related Art

A grain-oriented electrical steel sheet has a crystal structure with (110) and [001] as a main orientation and is used much as a material of a magnetic iron core. In particular, a material that has low iron loss is required in order to reduce energy loss. With regard to such requirements, an iron alloy that includes iron and silicon is known such that magnetic domain refinement occurs and eddy current loss, which is a major factor in iron loss, is reduced when external tension is applied. In general, in order to reduce the iron loss of a grain-oriented electrical steel sheet that includes silicon of 5% or less, it is effective to apply tension to the steel sheet. The tension is typically applied by a film formed on the surface of the steel sheet.

Conventionally, a grain-oriented electrical steel sheet having a sheet thickness of 0.23 mm is subjected to a tension of about 1.0 kgf/mm$^2$ by two layers of films with a first film that includes as a main compound forsterite formed by the reaction of oxides with an annealing separator on the surface of the steel sheet in a final annealing process and a second film that is formed by baking of a coating solution that includes as a main compound colloidal silica and phosphate. Such a film is required to have various functions, such as corrosion resistance, water resistance, sliding properties during machining, and annealing resistance during stain relief annealing, in addition to the effect of applying tension. Since a film merely composed of phosphate and silica had a problem, for example, in annealing resistance, the problem was solved by adding a chromium compound to the film conventionally as disclosed in Japanese Unexamined Patent Application, First Publication No. S48-39338. This is a method that chromic acid added to the coating solution removes harmful effect of the film component, which has an adverse effect on annealing resistance. Chromium itself is reduced into a trivalent state during baking, and may form a compound with phosphorus.

Although the method of forming a film that includes chromium is a technology that can realize excellent film characteristics by using trivalent chromium having a little environmental load, the current technology trend is to develop a tension film that does not use chromic acid, which needs attention in handling in its producing process. For example, Japanese Unexamined Patent Application, First Publication No. H6-65754 discloses a film that includes aluminum borate as a major compound. However, this has the problem of poor water resistance. In addition, Japanese Unexamined Patent Application, First Publication No. S61-235514 discloses a technology of TiN coating. However, this has the problem of cost, since it is a dry coating technology.

Meanwhile, Japanese Unexamined Patent Application, First Publication No. 2007-23329 discloses a technology that improves film characteristics, such as tension and water resistance, by adding a suspension liquid including Ti, Zr, or the like, or Fe into a coating solution in the forming of a film, and baking the coating solution on a steel sheet. This technology aims to improve characteristics by adding a metal compound in the colloidal state into the coating solution so that the metal compound stabilizes free phosphate as well as to improve a porous structure which is easily generated on the film that does not include chromium. Although this technology had a certain degree of effect in improving water resistance, the improvement effect was not always sufficient. In addition, due to the addition of the suspension liquid, neither the viscosity stability nor the aggregation resistance of the coating solution was sufficient and there was a possibility of problems in the stable formation of the film.

Japanese Unexamined Patent Application, First Publication No. 2005-187924 discloses a method of improving the characteristics of a film using sulfate of manganese or the like. However, in this technology, the film of the sulfate of manganese or the like is required to have a two-layer structure, with the upper layer being essentially a film composed of silica and an organic film. In addition, it was difficult to apply this technology to the current producing process of electric steel sheets. Therefore, this known technology was not able to sufficiently improve annealing resistance at a low cost.

SUMMARY OF THE INVENTION

The present invention solves the problem of lowering annealing resistance. That is, the invention provides a grain-oriented electrical steel sheet, which includes a film without chromium on the outermost surface thereof and has excellent annealing resistance, and a producing method therefor.

The present invention relates to a tension film that has phosphate and silica as constituents, and includes a manganese (Mn) compound. This can be produced by performing application, drying, and baking a raw material solution, which includes the manganese compound, phosphate and silica, on a grain-oriented electrical steel sheet after final annealing has been completed.

That is, the grain-oriented electrical steel sheet according to the present invention has a film, which includes a phosphate, silica, a manganese compound, and a potassium compound, on the outermost surface of the steel sheet. The phosphate includes at least one selected from among Al, Mg, Ni, Mn, Co, Mo, Zr, Sr, and Ca. The film has a composition that includes 100 parts by mass of the phosphate expressed as a solid material, 20 to 80 parts by mass of the silica expressed as a solid material, and 0.5 to 15 parts by mass of the manganese compound other than the phosphate expressed as manganese dioxide. The mole ratio K/Mn of potassium to manganese is equal to or more than 0.02 and equal to or less than 2.0.

In addition, the producing method of a grain-oriented electrical steel sheet according to the present invention includes the processes of applying a solution on a surface of a grain-oriented electrical steel sheet after final annealing has been completed, drying the solution, and baking the solution at a temperature range of 800° C. to 1000° C., thereby forming an oxide film, wherein the solution includes a phosphate, silica, a manganese compound, and a potassium compound, wherein the phosphate includes among these at least one or more selected from the group consisting of Al, Mg, Ni, Mn, Co, Mo, Zr, Sr, and Ca, wherein the solution has a composition that includes 100 parts by mass of the phosphate expressed as a solid material, 20 to 80 parts by mass of the silica expressed as a solid material, 0.5 to 15 parts by mass of the manganese compound other than the phosphate expressed as manganese dioxide, and wherein a mole ratio K/Mn of potassium to manganese is 0.02 to 2.0.

Furthermore, in the producing method of a grain-oriented electrical steel sheet according to the present invention, the manganese compound may be a potassium permanganate, and the solution including a phosphate, silica, a manganese compound, and a potassium compound has 5% to 50% of a solid material.

The film of grain-oriented electrical steel sheet of the present invention has phosphate and silica as main compounds and includes a manganese compound and a potassium compound as essential components added thereto. Thereby, it is possible to produce a grain-oriented electrical steel sheet that has excellent magnetic characteristics due to a film, which has various excellent characteristics such as annealing resistance, although chromium is not included.

DETAILED DESCRIPTION OF THE INVENTION

As a result of various examinations repeated to improve the water resistance and annealing resistance of a film, the inventors found that it is possible to obtain the improvement effect if a manganese compound is present in the film. Although the mechanism of manganese in the film that improves annealing resistance is not yet clearly understood, it is presumed that manganese in the film forms a complex oxide with a free phosphoric acid and stabilizes the free phosphoric acid, thereby improving annealing resistance. Therefore, it is regarded that the more the amount of manganese is, the easier it might be to improve the annealing resistance.

Regarding a film which includes a manganese compound, a technology that forms a tension film using manganese phosphate is disclosed, for example, in Japanese Unexamined Patent Application, First Publication No. 2005-187924. However, in Japanese Unexamined Patent Application, First Publication No. 2005-187924, a coating solution is prepared in the form of manganese phosphate regarding manganese and the amount of manganese cannot be increased above a certain level as in the present invention. Therefore, regarding important characteristics of the film such as annealing resistance, Japanese Unexamined Patent Application, First Publication No. 2005-187924 cannot obtain the effect which is the same as that of the present invention.

The method of forming a film in the present invention is not limited to a specific method. However, a method of preparing, applying, drying, and baking a coating solution can be applied in the simplest fashion. In addition, although the present invention can be generally applied irrespective of the types of phosphate in the film, it is possible to produce a good film, which is flat and smooth, by selecting phosphate that includes one or two or more metals selected from among Al, Mg, Ni, Mn, Co, Mo, Zr, Sr, and Ca.

If phosphate is prepared in the form of a solution, it is easy to prepare a coating solution. For simplicity of film formation process, colloidal silica is most favorable source of silica in the film.

The form of a manganese compound existing in the film consists mainly of manganese phosphate and manganese oxide. Manganese oxide is effective in improving annealing resistance. However, if the amount of manganese oxide is excessive, it has an adverse effect on film-forming characteristics since the tension of the film decreases or cracks are formed. The amount of manganese oxide can be controlled by controlling the amount of the manganese compound to be added. That is, if the composition of the film includes 100 parts by mass of phosphate expressed as a solid material, silica is set to be 20 to 80 parts by mass as a solid material, and manganese compound other than phosphate is set 0.5 to 15 parts by mass as manganese dioxide. If the amount of manganese dioxide is less than this range, it is impossible to obtain the effect of improved annealing resistance, since the free phosphate is not sufficiently stabilized. Meanwhile, if the amount of manganese dioxide is excessive, film characteristics as described above are deteriorated. In addition, phosphorous and metal elements in the film can be quantified by a known general method, such as chemical analysis.

The method of introducing a manganese compound into the film can use a water-soluble manganese compound. This is, as described later, because dry baking after application of an aqueous film-forming agent is cost effective, and a water soluble compound is easily introduced into the aqueous agent. In this case, a method of using water-insoluble oxide or carbonate is possible. However, the water-insoluble oxide or carbonate is required to be in the form of particulates or a colloidal substance so that suspension liquid can be prepared. Therefore, this method is accompanied with difficulties in manufacturing. In addition, in the case of the colloidal substance, a component for ensuring dispersibility is necessary. However, the problem is that this often damages the stability of the coating solution. Based upon the above understanding, the inventors compared and analyzed water-soluble manganese compounds.

Examples of the water-soluble manganese compounds, which can be manufactured at a relatively low cost, include nitrides, sulfates, chlorides, some of salts of oxometallic acid salts or peroxometallic acid salts, and the like. Among these examples, nitrides, sulfates, and chlorides generate gaseous matter due to the decomposition of nitride, sulfide, or chloride during baking of the film if they are used at an amount according to the film composition of the present invention. Thus, they have an adverse effect on the density of the film and further will worsen water resistance and annealing resistance. Meanwhile, if permanganate is used, such problems do not occur and intended film characteristics can be obtained according to the result. The type of permanganate is preferably a salt of an alkali metal such as sodium or potassium; an alkali earth metal such as magnesium; Zn; or the like in consideration of the stability of the coating solution. Among these, potassium is particularly preferable. When other substances are used instead of the above-mentioned metals, according to the composition of this coating solution including colloidal silica, the coating solution tends to become instable due to precipitation or the like.

Among the permanganates as mentioned above, potassium permanganate is overwhelmingly advantageous for low-cost manufacturing. In addition, potassium included in the film has special effects in improving the flatness and smoothness of the film and producing a visually appealing film. In this case, if the composition is set so that the mole ratio of potassium to manganese (K/Mn) is equal to or more than 0.02 and equal to or less than 2, the amount of manganese oxide can be set to a desirable range. It is particularly preferable that the mole ratio be equal to or more than 0.04 and equal to or less than 1.2. Here, if the K/Mn ratio is too large, amorphous components in the tension film become unstable, thereby worsening the adhesive property of the tension film. Meanwhile, if the K/Mn ratio is too small, the flatness and smoothness of the film is lost and defects frequently occur, thereby degrading corrosion resistance.

Although the mechanism of potassium contributing to the flatness and smoothness of the film has not been clarified yet, the inventors assume it is due to the following. That is, it is assumed that, as one of desirable forms that produce a flat film, a compound, in which silica is uniformly dispersed and phosphate is reacted with part of silica, has a stable glass structure. Here, potassium is accepted as a constituent element of network modifying oxide in the glass structure and, in this case, is regarded to contribute to stabilization of glass.

The value of the K/Mn ratio becomes 1 or less when potassium permanganate is used. In order to increase this value, it is possible to use water-soluble potassium salts, for example, an organic acid salt, such as potassium acetate or potassium oxalate. An inorganic salt, such as potassium chloride or potassium nitrate, can also be used if a small amount is added. However, it is generally impossible to produce a dense film if the amount of the inorganic salt exceeds 5 parts by mass with respect to 100 parts by mass of phosphate, because of the problem of decomposition gas.

Although the present invention is essentially required to include a manganese compound in addition to phosphate and silica, other components can be mixed without any problem. In addition, the structure formed by these components may be in the form of glass substance or crystal substance. These components may be inevitably mixed from other components or impurities in the film, or intentionally added into the coating solution.

In the case of applying the coating solution on the steel sheets, a method of preparing the coating solution by dissolving or dispersing the above-described raw materials into a solution can be the simplest method. Although water is most suitable for a dispersing medium, any of organic solvents or mixtures thereof can be used if they have no special problems in other processes. Since the film of the grain-oriented electrical steel sheet of the present invention has a volume fraction that decreases if the film is too thick, it is preferable that the film be as thin as possible according to the usage. That is, the film thickness is, preferably, 5% or less and, more preferably, 2% or less with respect to the thickness of the steel sheet. In addition, in terms of application of tension, the lower limit of the film thickness is preferably 0.1 μm, since a sufficient effect cannot be realized if the thickness of the film is extremely small.

The coating solution produced as above is applied on the surface of the grain-oriented electrical steel sheet after final annealing is completed, using a known method of the conventional techniques, a coater such as a roll coater or the like, a dipping method, a spraying method, or an electrophoresis method.

The steel sheet, described herein to which final annealing has been completed, indicates (1) a steel sheet on which a first film made of forsterite is formed on the surface by final annealing performed in a known method of the conventional techniques, (2) a steel sheet from which a first film and an additionally generated inner oxide layer are removed by immersion into acid, (3) a steel sheet produced by subjecting the steel sheet produced in above described (2) to surface smoothing annealing in hydrogen or polishing such as chemical or electrolytic-polishing, or (4) a steel sheet produced by applying an annealing separator known in the conventional techniques, such as alumina which does not form forsterite, or chloride additives of small amount to prevent forsterite formation, and performing final annealing under conditions that do not form a first film.

Next, after the application, the steel sheet is dried and is then baked at a temperature 800° C. to 1000° C., thereby forming an oxide film on the surface thereof. It is preferable that the baking be performed in inert gas atmosphere including nitrogen or the like, or a reducing atmosphere such as a nitrogen-hydrogen mixed atmosphere. Here, an atmosphere including air or oxygen is not preferable since there is a possibility that the steel sheet will be oxidized.

Here, in order to produce a sound film, the amount of solid of the coating solution having the above composition is required to be 5% to 50%. If the amount of solid is less than this range, defects are apt to occur during drying and a sound film cannot be produced after baking, since moisture content is too large. Meanwhile, if the amount of solid is too large, defects are apt to occur during drying. In addition, since the coating solution becomes instable, silica aggregation or the like occurs in the solution. Therefore, a sound film is not produced and, in some cases, water resistance is lowered. In order to increase the amount of solid, a method of adding solid manganese compound to the coating solution in the last stage may be used.

The dew point of atmospheric gas is not specifically limited. In addition, if the baking temperature is below 800° C., it is not preferable since solid in the coating solution fails to form a sufficiently dense film and a sufficient level of tension is not realized due to the low baking temperature. Meanwhile, if the baking temperature is above 1000° C., although the film does not have a significant problem, it is not economical.

Hereinafter, the present invention will be described in more detail with respect to examples. However, the following examples are not intended to limit the present invention.

Example 1

Effect of Addition of Manganese Compound

A coating solution, which included 100 parts by mass of aluminum biphosphate expressed as a solid material, 55 parts by mass of colloidal silica expressed as a solid material, and potassium permanganate having an addition amount presented in Table 1, was prepared. Here, the aluminum biphosphate included 50% of a solid material, and the colloidal silica included 30% of a solid material. The potassium permanganate source was solid, and was used by being dissolved into a mixed solution in which aluminum biphosphate and colloidal silica were mixed. The concentration of solid was in the range from 5% to 50% in all cases, and the K/Mn ratio was 1 in all cases. The coating solution above was applied and dried on grain-oriented electrical steel sheets after final annealing was completed (including a first film made of forsterite). Here, the grain-oriented electrical steel sheets included 3.2% of Si and had a thickness of 0.23 mm, and the amount of the coating solution was set so that the film had a weight of 4 g/m$^2$ after baking. Afterwards, an oxide film was formed on the surface by baking in an atmosphere, including 3% of hydrogen, at 850° C. for 30 seconds. Subsequently, magnetic domain control was performed by laser irradiation.

Table 2 presents the results obtained by measuring various characteristics of the film. The adhesive property was evaluated by film peeling of a winding test in a condition in which the steel sheets were wound around a column of ϕ20 mm so that the angle of the steel sheets became 180 degrees. Annealing resistance was evaluated by overlapping and fixing steel sheets, followed by annealing at 850° C. for 2 hours in nitrogen, and measuring a force necessary for peeling the films. From this, it can be understood that annealing resistance is good in the case where the amount of manganese dioxide due to addition of potassium permanganate is high. Meanwhile, the tension of the film is worsened in the area in which the amount of manganese dioxide due to addition of potassium permanganate is large.

Corrosion resistance was evaluated by holding the steel sheets in an atmosphere of 50° C. and 91% RH for a week, measuring an increase in weight, and visually observing surface conditions. In addition, the film was removed from one side, and tension applied to the steel sheet calculated from the curve of the sheet and magnetic characteristics, are also presented in Table 2. From the results of Table 2, it can be appreciated that examples according to the scope of the present invention produced the grain-oriented electrical steel sheets, all of which had a good film and a low iron loss.

TABLE 1

| | Mass part of manganese dioxide by potassium permanganate |
|---|---|
| Comparative Example | 0.1 |
| Comparative Example | 0.3 |
| Example | 0.5 |
| Example | 1 |
| Example | 3 |
| Example | 8 |
| Example | 15 |
| Comparative Example | 17 |
| Comparative Example | 20 |

3% of hydrogen, at 850° C. for 30 seconds. Subsequently, magnetic domain control was performed by laser irradiation.

Table 4 presents the results obtained by measuring various characteristics of the film. The adhesive property was evaluated by film peeling of a winding test in a condition in which the steel sheets were wound around a column of ϕ20 mm so that the angle of the steel sheets became 180 degrees. Annealing resistance was evaluated by overlapping and fixing steel sheets, followed by annealing at 850° C. for 2 hours in nitrogen, and measuring a force necessary for peeling the films. According to the results, the film tension was worsened if the amount of the colloidal silica is less than 20 parts by mass as a solid material with respect to 100 parts by mass of aluminum biphosphate expressed as a solid material. In addition, the flatness and smoothness of the film in this case was inadequate. Furthermore, the film tension is deteriorated if the amount of colloidal silica is greater than 80 parts by mass as a solid material.

From the results of Table 4, it can be appreciated that examples according to the scope of the present invention can produce grain-oriented electrical steel sheets, all of which have a good film and a low iron loss.

TABLE 2

| | | | Annealing resistance | | Film tension | | Magnetic characteristics | |
|---|---|---|---|---|---|---|---|---|
| | Adhesive property | Corrosion resistance | Measured value (g/9 cm$^2$) | Rating | Measured value (kg/mm$^2$) | Rating | B8 (T) | W17/50 (W/kg) |
| Comparative Example | A | A | 800 | C | 0.82 | A | 1.93 | 0.83 |
| Comparative Example | A | A | 620 | C | 0.83 | A | 1.91 | 0.84 |
| Example | A | A | 160 | A | 0.82 | A | 1.93 | 0.82 |
| Example | A | A | 140 | A | 0.83 | A | 1.92 | 0.83 |
| Example | A | A | 120 | A | 0.86 | A | 1.94 | 0.84 |
| Example | A | A | 110 | A | 0.86 | A | 1.92 | 0.82 |
| Example | A | A | 130 | A | 0.79 | A | 1.94 | 0.82 |
| Comparative Example | A | B | 100 | A | 0.68 | C | 1.92 | 0.91 |
| Comparative Example | A | B | 100 | A | 0.61 | C | 1.93 | 0.94 |

Adhesive property: A indicates no peeling

Corrosion resistance: A indicates no rust, B indicates rust in some portions

Annealing resistance: A indicates good, C indicates bad

Film tension: A indicates good, C indicates bad

Example 2

Effect of Ratio Control of Phosphate and Colloidal Silica

A coating solution presented in Table 3 was prepared using aluminum biphosphate including 50% of solid and colloidal silica including 30% of solid. The concentration of solid was in the range from 5% to 50% in all cases, and the K/Mn ratio was 1 in all cases. The coating solution as above was applied and dried on grain-oriented electrical steel sheets after final annealing was completed (including a first film made of forsterite). Here, the grain-oriented electrical steel sheets included 3.2% of Si and had a thickness of 0.23 mm, and the amount of the coating solution was set so that the film had a weight of 4 g/m$^2$ after baking. Afterwards, an oxide film was formed on the surface by baking in an atmosphere, including

TABLE 3

| | Mass part of aluminum phosphate | Mass part of colloidal silica | Mass part of manganese dioxide by potassium permanganate |
|---|---|---|---|
| Comparative Example | 100 | 10 | 5 |
| Comparative Example | | 17 | |
| Example | | 20 | |
| Example | | 35 | |
| Example | | 50 | |
| Example | | 70 | |
| Example | | 80 | |
| Comparative Example | | 90 | |

TABLE 4

| | Adhesive property | Corrosion resistance | Annealing resistance Measured value (g/9 cm$^2$) | Annealing resistance Rating | Film tension Measured value (kg/mm$^2$) | Film tension Rating | Magnetic characteristics B8 (T) | Magnetic characteristics W17/50 (W/kg) |
|---|---|---|---|---|---|---|---|---|
| Comparative Example | A | C | 320 | C | 0.52 | C | 1.91 | 0.95 |
| Comparative Example | A | C | 240 | C | 0.63 | C | 1.92 | 0.93 |
| Example | A | A | 150 | A | 0.78 | A | 1.91 | 0.82 |
| Example | A | A | 160 | A | 0.83 | A | 1.93 | 0.83 |
| Example | A | A | 120 | A | 0.86 | A | 1.92 | 0.84 |
| Example | A | A | 120 | A | 0.79 | A | 1.91 | 0.82 |
| Example | A | A | 100 | A | 0.76 | A | 1.93 | 0.87 |
| Comparative Example | A | B | 130 | A | 0.61 | C | 1.92 | 0.94 |

Adhesive property: A indicates no peeling
Corrosion resistance: A indicates no rust, B indicates rust in some portions
Annealing resistance: A indicates good, C indicates bad
Film tension: A indicates good, C indicates bad

Example 3

Effect of Concentration Control of Solid

A coating solution, which included 100 parts by mass of aluminum biphosphate expressed as a solid material, 55 parts by mass of colloidal silica expressed as a solid material, and 5 parts by mass of potassium permanganate expressed as a solid material, was prepared. Here, the aluminum biphosphate included 50% of a solid material, and the colloidal silica included 30% of a solid material. The used potassium permanganate source was solid or liquid, and was added into a mixed solution in which aluminum biphosphate and colloidal silica were mixed, and the amounts of solid was adjusted according to those presented in Table 5. The K/Mn ratio was 1 in all cases. The coating solution above was applied and dried on grain-oriented electrical steel sheets after final annealing was completed (including a first film made of forsterite). Here, the grain-oriented electrical steel sheets included 3.2% of Si and had a thickness of 0.23 mm, and the amount of the coating solution was set so that the film had a weight of 4 g/m$^2$ after baking. Afterwards, an oxide film was formed on the surface by baking in an atmosphere, including 3% of hydrogen, at 850° C. for 30 seconds. Subsequently, magnetic domain control was performed by laser irradiation.

Corrosion resistance was evaluated by holding the steel sheets in an atmosphere of 50° C. and 91% RH for a week, measuring an increase in weight, and checked surface conditions visually. In addition, the film was removed from one side, and tension applied to the steel sheet calculated from the curve of the sheet and magnetic characteristics were measured. The results are also presented in Table 5. According to the results, a problem occurs during drying if the concentration of solid of the coating solution is too low. In addition, if the concentration of solid is too high, the coating solution becomes instable and aggregation occurs easily. This prevents normal drying and, in some cases, after the film is applied and baked, defects may be formed therein. It is believed that such defects can be solved by improving the drying method. However, if the concentration of solid is set to the range according to the scope of the invention, it is possible to simply produce grain-oriented electrical steel sheets, all of which have a good film and a low iron loss.

TABLE 5

| | Amount of Solid (mass %) | Defect in film | Corrosion resistance | Film tension Measured value (kg/mm$^2$) | Film tension Rating | Magnetic characteristics B8 (T) | Magnetic characteristics W17/50 (W/kg) |
|---|---|---|---|---|---|---|---|
| Comparative Example | 2 | Minute | B | 0.77 | A | 1.91 | 0.87 |
| Comparative Example | 3 | Minute | B | 0.78 | A | 1.93 | 0.86 |
| Example | 5 | None | A | 0.82 | A | 1.92 | 0.82 |
| Example | 15 | None | A | 0.83 | A | 1.93 | 0.83 |
| Example | 30 | None | A | 0.86 | A | 1.92 | 0.84 |
| Example | 50 | None | A | 0.79 | A | 1.91 | 0.82 |
| Comparative Example | 55 | Minute | B | 0.80 | A | 1.94 | 0.85 |
| Comparative Example | 60 | Minute | B | 0.77 | A | 1.91 | 0.88 |

Adhesive property: A indicates no peeling
Corrosion resistance: A indicates no rust, B indicates rust in some portions
Annealing resistance: A indicates good, C indicates bad
Film tension: A indicates good, C indicates bad

Example 4

Types of Phosphate

As presented in Table 6, a coating solution, which included 100 parts by mass of biphosphate expressed as a solid material, 55 parts by mass of colloidal silica expressed as a solid material, and a potassium permanganate additive, was prepared. Here, the biphosphate was a single biphosphate or a biphosphate mixture, including 50% of a solid material, and the colloidal silica included 30% of a solid material. The mixing ratio between phosphates was 1 to 1 by volume ratio. In addition, potassium acetate was used to analyze the case where the value of the K/Mn ratio was 1 or more. In the coating solution prepared as above, the concentration of solid was in the range from 5% to 50% in all cases. The coating solution above was applied and dried on grain-oriented electrical steel sheets after final annealing was completed (including a first film made of forsterite). Here, the grain-oriented electrical steel sheets included 3.2% of Si and had a thickness of 0.23 mm, and the amount of the coating solution was set so that the film had a weight of 4 g/m$^2$ after baking. Afterwards, an oxide film was formed on the surface by baking in an atmosphere, including 3% of hydrogen, at 850° C. for 30 seconds. Subsequently, magnetic domain control was performed by laser irradiation.

Table 7 presents the results obtained by measuring various characteristics of individual films presented in Table 6. Thus, individual film samples are presented in the same order in Tables 6 and 7. From the results presented in Table 7, good films could be produced in all cases of phosphates. In addition, annealing resistance was improved due to addition of potassium permanganate, and if the amount of addition matches the range of the scope of the present invention, significant improvement effect was obtained.

TABLE 6

| | | Additive | | | |
|---|---|---|---|---|---|
| | Phosphate | Type | Mass part of manganese dioxide | Mass part of potassium acetate | K/Mn ratio |
| Comparative Example | Ni phosphate | Potassium permanganate | 0.3 | — | 1 |
| Example | | | 3.5 | | |
| Comparative Example | Mg phosphate | | 0.3 | | |
| Example | | | 3.5 | | |
| Comparative Example | Mn phosphate | | 0.3 | | 0.01 |
| Example | | | 3.5 | | 0.09 |
| Comparative Example | Co phosphate | | 0.3 | | 1 |
| Example | | | 3.5 | | |
| Comparative Example | Mo phosphate | | 0.3 | | |
| Example | | | 3.5 | | |
| Comparative Example | Zn phosphate | | 0.3 | | |
| Example | | | 3.5 | | |
| Comparative Example | Sr phosphate | | 0.3 | | |
| Example | | | 3.5 | | |
| Comparative Example | Ca phosphate | | 0.3 | | |
| Example | | | 3.5 | | |
| Comparative Example | Al phosphate + Ni phosphate | | 0.3 | | |
| Example | | | 0.5 | | |
| Example | | | 7 | | |
| Example | | | 15 | | |
| Comparative Example | | | 17 | | |
| Comparative Example | Al phosphate + Mg phosphate | | 0.3 | | |
| Example | | | 0.5 | | |
| Example | | | 7 | | |
| Example | | | 15 | | |
| Comparative Example | | | 17 | | |
| Comparative Example | Al phosphate + Mn phosphate | | 0.3 | | 0.02 |
| Example | | | 0.5 | | 0.03 |
| Example | | | 7 | | 0.29 |
| Example | | | 15 | | 0.46 |
| Comparative Example | | | 17 | | 0.49 |
| Example | Al phosphate | | 7 | 0.1 | 1.01 |
| Example | | | | 0.5 | 1.06 |
| Example | | | | 1.5 | 1.19 |
| Example | | | | 7 | 1.89 |
| Comparative Example | | | | 10 | 2.27 |

TABLE 7

| | | | Annealing resistance | | Film tension | | Magnetic characteristics | |
|---|---|---|---|---|---|---|---|---|
| | Adhesive property | Corrosion resistance | Measured value (g/9 cm$^2$) | Rating | Measured value (kg/mm$^2$) | Rating | B8 (T) | W17/50 (W/Kg) |
| Comparative Example | A | A | 710 | C | 0.82 | A | 1.93 | 0.82 |
| Example | A | A | 150 | A | 0.82 | A | 1.93 | 0.84 |
| Comparative Example | A | A | 700 | C | 0.84 | A | 1.92 | 0.81 |
| Example | A | A | 130 | A | 0.8 | A | 1.94 | 0.83 |
| Comparative Example | A | A | 690 | C | 0.81 | A | 1.92 | 0.85 |
| Example | A | A | 140 | A | 0.83 | A | 1.93 | 0.82 |
| Comparative Example | A | A | 750 | C | 0.82 | A | 1.92 | 0.8 |
| Example | A | A | 160 | A | 0.81 | A | 1.94 | 0.82 |
| Comparative Example | A | A | 680 | C | 0.83 | A | 1.93 | 0.82 |
| Example | A | A | 150 | A | 0.81 | A | 1.94 | 0.81 |
| Comparative Example | A | A | 810 | C | 0.83 | A | 1.93 | 0.84 |
| Example | A | A | 140 | A | 0.84 | A | 1.93 | 0.81 |
| Comparative Example | A | A | 780 | C | 0.83 | A | 1.92 | 0.83 |
| Example | A | A | 170 | A | 0.82 | A | 1.93 | 0.84 |
| Comparative Example | A | A | 650 | C | 0.84 | A | 1.91 | 0.83 |
| Example | A | A | 180 | A | 0.81 | A | 1.92 | 0.82 |
| Comparative Example | A | A | 560 | C | 0.81 | A | 1.94 | 0.83 |
| Example | A | A | 170 | A | 0.83 | A | 1.93 | 0.84 |
| Example | A | A | 130 | A | 0.84 | A | 1.93 | 0.81 |
| Example | A | A | 100 | A | 0.81 | A | 1.92 | 0.83 |
| Comparative Example | B | B | 70 | A | 0.63 | C | 1.94 | 0.92 |
| Comparative Example | A | A | 630 | C | 0.83 | A | 1.92 | 0.81 |
| Example | A | A | 150 | A | 0.81 | A | 1.94 | 0.83 |
| Example | A | A | 120 | A | 0.8 | A | 1.9 | 0.83 |
| Example | A | A | 100 | A | 0.82 | A | 1.93 | 0.84 |
| Comparative Example | B | B | 80 | A | 0.64 | C | 1.93 | 0.94 |
| Comparative Example | A | A | 560 | C | 0.85 | A | 1.94 | 0.82 |
| Example | A | A | 150 | A | 0.82 | A | 1.93 | 0.84 |
| Example | A | A | 140 | A | 0.81 | A | 1.93 | 0.82 |
| Example | A | A | 120 | A | 0.81 | A | 1.92 | 0.84 |
| Comparative Example | B | B | 110 | A | 0.58 | C | 1.93 | 0.93 |
| Example | A | A | 140 | A | 0.83 | A | 1.91 | 0.83 |
| Example | A | A | 150 | A | 0.84 | A | 1.92 | 0.82 |
| Example | A | A | 170 | A | 0.82 | A | 1.91 | 0.82 |
| Example | A | A | 160 | A | 0.81 | A | 1.92 | 0.83 |
| Comparative Example | B | B | 210 | A | 0.57 | C | 1.91 | 0.93 |

Adhesive property: A indicates no peeling, B indicates peeling in some portions (area ratio less than 50%)

Corrosion resistance: A indicates no rust, B indicates rust in some portions

Annealing resistance: A indicates good, C indicates bad

Film tension: A indicates good, C indicates bad

Example 5

Annealing Temperature Conditions

A coating solution was prepared by mixing aluminum biphosphate having a solid concentration of 50% and colloidal silica having a solid concentration of 30%, at a ratio with 100 parts by mass of aluminum biphosphate expressed as a solid material and 55 parts by mass of colloidal silica expressed as a solid material, and mixing potassium permanganate to the mixture so that the amount of potassium permanganate becomes 5 parts by mass in terms of manganese dioxide. The concentration of solid was 30%, and the K/Mn ratio was 1 in all cases. The coating solution above was applied and dried on grain-oriented electrical steel sheets after final annealing was completed (including a first film made of forsterite). Here, the grain-oriented electrical steel sheets included 3.2% of Si and had a thickness of 0.23 mm, and the amount of the coating solution was set so that the film had a weight of 4 g/m$^2$ after baking. Afterwards, an oxide film was formed on the surface by baking in an atmosphere, including 3% of hydrogen, at a temperature from 700° C. to 950° C. for 30 seconds. Subsequently, magnetic domain control was performed by laser irradiation.

Table 8 presents the results obtained by measuring various characteristics of the film. Due to the results presented in Table 8, in the case of examples in which baking was performed at 800° C. or more, good characteristics for annealing resistance were obtained.

From the results of Table 8, it can be appreciated that examples annealed at a temperature according to the scope of the present invention can produce grain-oriented electrical steel sheets, all of which have a good film and a low iron loss.

TABLE 8

| | Baking temperature (° C.) | Adhesive property | Corrosion resistance | Annealing resistance (g/9 cm$^2$) | | Film tension (kg/mm$^2$) | | Magnetic characteristics B8 (T) | W17/50 (W/kg) |
|---|---|---|---|---|---|---|---|---|---|
| Comparative Example | 700 | B | C | 950 | C | 0.43 | C | 1.92 | 0.95 |
| Example | 800 | A | A | 180 | A | 0.86 | A | 1.93 | 0.82 |
| Example | 850 | A | A | 130 | A | 0.84 | A | 1.93 | 0.83 |
| Example | 950 | A | A | 90 | A | 0.89 | A | 1.94 | 0.88 |

Adhesive property: A indicates no peeling, B indicates peeling in some portions (less than 50% by area ratio)
Corrosion resistance: A indicates no rust, C indicates rust in entire surface
Annealing resistance: A indicates good, C indicates bad
Film tension: A indicates good, C indicates bad The grain-oriented electrical steel sheet of the present invention includes phosphate and silica as main compounds, to which a manganese compound and a potassium compound are added as essential components. Since this makes it possible to produce the grain-oriented electrical steel sheet that has a film having various excellent characteristics, such as annealing resistance, and that has good magnetic characteristics without including chromium, the industrial applicability is large.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A grain-oriented electrical steel sheet comprising a film on an outermost surface of a steel sheet, wherein the film comprises a phosphate, a silica, a manganese compound, and a potassium compound, wherein the phosphate includes one or more metals selected from the group consisting of Al, Mg, Ni, Mn, Co, Mo, Zr, Sr, and Ca, wherein relative amounts of the phosphate, the silica, and the manganese compound in the film are 100 parts by mass of the phosphate expressed as a solid material, 20 to 80 parts by mass of the silica expressed as a solid material, and 0.5 to 15 parts by mass of the manganese compound other than the phosphate expressed as a manganese dioxide, and wherein a mole ratio K/Mn of potassium to manganese is 0.02 to 2.0.

2. A method of producing a grain-oriented electrical steel sheet, the method comprising:

applying a solution on a surface of a grain-oriented electrical steel sheet after final annealing is completed, drying the solution, and baking the steel sheet at a temperature range equal to or more than 800° C. and equal to or less than 1000° C., thereby forming an oxide film, wherein the solution comprises a phosphate, a silica, a manganese compound, and a potassium compound, wherein the phosphate comprises one or more metal selected from the group consisting of Al, Mg, Ni, Mn, Co, Mo, Zr, Sr, and Ca, wherein relative amounts of the phosphate, the silica, and the manganese compound in the solution are 100 parts by mass of the phosphate expressed as a solid material, 20 to 80 parts by mass of the silica expressed as a solid material, and 0.5 to 15 parts by mass of the manganese compound other than the phosphate expressed as a manganese dioxide, wherein a mole ratio K/Mn of potassium to manganese is 0.02 to 2.0, and wherein the solution has a solid material in the range of 5 mass % or more and 50 mass % or less.

3. The method of producing a grain-oriented electrical steel sheet according to claim 2, wherein the manganese compound is a potassium permanganate.

4. A grain-oriented electrical steel sheet comprising a film on an outermost surface of a steel sheet, wherein the film comprises a phosphate, a silica, a manganese compound, and a potassium compound, wherein the phosphate includes one or more metals selected from the group consisting of Al, Mg, Ni, Mn, Co, Mo, Zr, Sr, and Ca, wherein relative amounts of the phosphate, the silica, and the manganese compound in the film are 100 parts by mass of the phosphate expressed as a solid material, 20 to 80 parts by mass of the silica expressed as a solid material, and 0.5 to 15 parts by mass of the manganese compound other than the phosphate expressed as a manganese dioxide, wherein a mole ratio K/Mn of potassium to manganese is 0.02 to 2.0, and wherein the film is formed by drying a solution having a solid material in the range of 5 mass % or more and 50 mass % or less.

5. A grain-oriented electrical steel sheet produced by the method of claim 2.

6. The method of producing a grain-oriented electrical steel sheet according to claim 2, wherein the manganese compound is a permanganate salt of a metal selected from the group consisting of an alkali metal, an alkali earth metal, and Zn.

7. The method of producing a grain-oriented electrical steel sheet according to claim 6, wherein the manganese compound is sodium permanganate, magnesium permanganate, or potassium permanganate.

8. The method of producing a grain-oriented electrical steel sheet according to claim 6, wherein the manganese compound is potassium permanganate.

9. The method of producing a grain-oriented electrical steel sheet according to claim 2, wherein the potassium compound is an organic acid salt of potassium or an inorganic acid salt of potassium.

10. The method of producing a grain-oriented electrical steel sheet according to claim 9, wherein the potassium compound is potassium acetate or potassium oxalate.

11. The method of producing a grain-oriented electrical steel sheet according to claim 9, wherein the potassium compound is potassium chloride or potassium nitrate.

12. The method of producing a grain-oriented electrical steel sheet according to claim 2, wherein the manganese compound and the potassium compound are both potassium permanganate.

13. The grain-oriented electrical steel sheet according to claim 1, wherein the manganese compound includes manganese phosphate and manganese oxide.

* * * * *